US007585374B2

(12) United States Patent
Sechelmann

(10) Patent No.: US 7,585,374 B2
(45) Date of Patent: Sep. 8, 2009

(54) METHOD FOR CLEANING WATER-BEARING DOMESTIC CLEANING APPLIANCES

(75) Inventor: Christian Eric Sechelmann, Brieselang (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 620 days.

(21) Appl. No.: 10/561,003

(22) PCT Filed: Jun. 9, 2004

(86) PCT No.: PCT/EP2004/006257

§ 371 (c)(1), (2), (4) Date: Dec. 16, 2005

(87) PCT Pub. No.: WO2005/001189

PCT Pub. Date: Jan. 6, 2005

(65) Prior Publication Data

US 2007/0094811 A1 May 3, 2007

(30) Foreign Application Priority Data

Jun. 23, 2003 (DE) ..... 103 28 071

(51) Int. Cl.
*B08B 7/04* (2006.01)
*B08B 9/00* (2006.01)

(52) U.S. Cl. ..... 134/18; 134/22.1; 134/56 R; 134/104.1; 68/12.02

(58) Field of Classification Search ..... 134/18, 134/104.1; 68/12.02
See application file for complete search history.

(56) References Cited

U.S. PATENT DOCUMENTS

2002/0078511 A1* 6/2002 Blair et al. ..... 8/159
2003/0089137 A1 5/2003 Jo
2003/0184597 A1 10/2003 Jo

FOREIGN PATENT DOCUMENTS

| | | | |
|---|---|---|---|
| DE | 44 35 096 | | 4/1996 |
| DE | 195 05 594 | | 8/1996 |
| DE | 197 42 282 | | 2/1999 |
| DE | 19742282 | * | 2/1999 |
| EP | 0 752 231 | | 1/1997 |
| EP | 1 211 373 | | 6/2002 |
| FR | 2 754 184 | | 4/1998 |
| JP | 2-104396 | | 4/1990 |

OTHER PUBLICATIONS

International Search Report PCT/EP2004/006257 Dec. 23, 2005.

* cited by examiner

*Primary Examiner*—Michael Kornakov
*Assistant Examiner*—Natasha Campbell
(74) *Attorney, Agent, or Firm*—James E. Howard

(57) ABSTRACT

A method for controlling a program-controlled water-bearing domestic cleaning appliance, especially a washing machine, which comprises a program control device that controls a water supply and outlet device, a heater and/or a drive device. For the purpose of cleaning, the structural components that come into contact with water during proper operation of the device, the so-called self-cleaning, the program control device controls water supply, discharge, water level, the speed of the driving motor and/or the duration of the drive control within at least one program section and/or the duration of at least one program section in such a manner that all structural components to be cleaned are wetted with water or the cleaning solution. This kind of self-cleaning should especially be carried out when the domestic cleaning appliance is put into operation for the first time. The invention is further characterized in that the program control device automatically recognizes the initial putting into operation.

10 Claims, No Drawings

METHOD FOR CLEANING WATER-BEARING DOMESTIC CLEANING APPLIANCES

The invention relates to a method for controlling a program-controlled water-bearing domestic cleaning appliance, especially a washing machine, comprising a program control device which controls a water supply and outlet device, a heating device and/or a drive device and which further controls the duration of a program section, the water level, the heating temperature, the driving speed and/or the duration of the drive control.

Such methods for control are generally used, for example in a washing machine or a dishwasher. These methods are designed for objects to be cleaned and/or cared for. In washing machines predominantly textiles and in dishwashers predominantly crockery and cutlery is to be cleaned. At the same time these methods are optimised with regard to the process duration and the consumption of water, cleaning agent and energy and with regard to the care of the material to be cleaned.

Auxiliary materials such as lubricants and joining agents or surface passivations, for example, were used to manufacture domestic cleaning appliances. These auxiliary materials cannot be completely removed during an appliance testing incorporated in the production sequence. Thus, small residues of these auxiliary materials remain inside the appliance. These auxiliary materials should in particular be completely removed from components which come into contact with water during proper operation before the domestic cleaning appliance is put into operation as prescribed so that the objects to be cleaned are not contaminated by these auxiliary materials. Thus, in the instructions for use of the domestic cleaning appliance the user is instructed that the unladen domestic cleaning appliance should be operated at least once using a cleaning agent, using a recommended program, such as the "cottons" program in the case of a washing machine, for example, before the appliance is put into use as prescribed.

The prescribed methods for cleaning and/or caring for household objects are not designed and optimised for cleaning the components of a domestic cleaning appliance which come into contact with water during proper operation. Thus, these methods for cleaning components use more time, water, cleaning agent and/or energy than is necessary for such special cleaning, especially before the domestic cleaning appliance is first put into operation. If a user does not note or only incompletely notes the instructions for use, and the domestic cleaning appliance is used as prescribed without previous cleaning of the components which come into contact with water during proper operation, the objects to be cleaned can be contaminated by auxiliary materials still remaining in the appliance during one of the first cleaning processes.

It is thus the object of the invention to propose a method for a domestic cleaning appliance described above by which means said auxiliary materials can be effectively removed. In this program self-cleaning should take place within a short program duration and at the same time using few resources such as water, cleaning agent and energy.

The object is solved according to the invention by a method for controlling a program-controlled water-bearing domestic cleaning appliance, a program control device controls the water supply, discharge, water level, the driving speed and/or the duration of the drive control within at least one program section and/or the duration of at least one program section such that all components coming into contact with water during proper operation are wetted with water and/or cleaning solution in this program section. This method is hereinafter called self-cleaning program.

The method according to the invention for a domestic cleaning appliance is specially optimised for the cleaning of components which come into contact with water during proper operation. Thus, these components can be cleaned in a shorter time than with a program which is intended for cleaning household objects (e.g. laundry). This self-cleaning should take place before the domestic cleaning appliance is first put into operation in order to remove auxiliary materials remaining as a result of manufacture. If, during the prescribed operation of the domestic cleaning appliance, the water-bearing components become severely contaminated, for example by dog hairs after washing a dog blanket or as a result of a forgotten paper handkerchief, the self-cleaning program can advantageously be carried out again.

In a further development of the invention according to the claims, the program control device automatically recognises a switch-on of the domestic cleaning appliance and then issues a prompt for carrying out a self-cleaning program. In addition, the program control device can bring about further outputs for additional prompts for operating actions and/or information instructions to which attention should be paid for carrying out the self-cleaning program. Advantageously, the instruction as to the dosing quantity of a cleaning agent which can be used for the self-cleaning can also be output. The dosing quantity is specially matched to the quantity of water used during self-cleaning. This positive guidance can advantageously ensure the self-cleaning of the domestic cleaning appliance without the user having completely read the instructions for use.

In order that self-cleaning is not carried out unnecessarily after every switch-on of the domestic cleaning appliance, according to the method according to claim 5 the program control device advantageously recognises a first switch-on of the device after manufacture of the appliance, the so-called first commissioning. Thereafter, no further prompt for carrying out the self-cleaning program is issued by the program control device when the domestic cleaning appliance is switched on repeatedly.

In the method for carrying out the self-cleaning of a domestic cleaning appliance, the program parameter for controlling the water supply is advantageously selected so that precisely only that much water is supplied or the water level is so low that just all the components coming into contact with water during proper operation are wetted. The water level in the washing machine can be selected to be so low that a laundry drum just dips into the water. In the event that a laundry drum has means for scooping the water, a water level up to the scooping means is sufficient. Thus, the water level can be reduced still further. Additional amounts of water such as are required for cleaning textiles for example in a washing machine are not required.

The method for carrying out the self-cleaning for a washing machine includes the choice of further advantageous program parameters. In order to make it possible to have a short duration of the self-cleaning program, a temperature in a wash program section of about 90.degree. C. has proved to be especially advantageous. The complete wetting and thus the cleaning of the components of a washing machine which come into contact with water during proper operation is additionally supported by moving the laundry drum and the circumferential speed of the laundry drum being greater than 1.1 m/s. In this case, the laundry drum is operated in intervals in alternating directions of rotation and/or the duration of the drive control is greater than 65%. Thus, the water located in the washing machine is held effectively in motion and the auxiliary materials are removed from the components. When using the parameters described previously, the self-cleaning program uses less water, cleaning agent and energy than previously when using a prescribed program of the domestic cleaning appliance.

For carrying out the self-cleaning, the water-bearing domestic cleaning appliance according to the invention comprises a program control device which generates control signals for a water supply and outlet device, a heater and/or a drive device such that the water supply, discharge, water level, the temperature, the driving speed and/or the duration of the drive control are variable within at least one program section and/or the duration of at least one program section. The arrangement of a water-bearing domestic cleaning appliance according to the invention is especially good for equipping a washing machine with a self-cleaning program.

The invention and its advantageous further developments are explained in detail hereinafter with reference to an exemplary embodiment for a washing machine.

During the manufacture and production of washing machines, auxiliary materials such as oil-containing lubricants are used. The appliance testing carried out at the end of the production process of each washing machine includes checking the function and safety of the washing machine. This appliance testing is not sufficient with regard to duration and intensity to completely remove all auxiliary materials from components coming into contact with water during proper operation. Consequently the prescribed operation is designed for the cleaning and care of objects, e.g. textiles in washing machines and is only suitable to a certain extent for self-cleaning of the washing machine from ecological and economic aspects.

Modern washing machines have a program control device which, among other things, controls a water supply and outlet device, a heater and a drive device. The duration of a program section, the water level, the temperature, the driving speed and the duration of the drive control are controlled or regulated using this program control device. If a microcontroller-assisted program control device with corresponding memory devices is used, the program configuration can be varied widely and inexpensive. Further, modern washing machines increasingly possess more numerous possibilities for control and program selection. Instead of the hitherto conventional simple program rotary selector switch, more and more menu-guided displays with associated input keys are being used. The number of programs offered is no longer limited by the number of rotary selector positions or by the size of the memory device. Thus, special programs are now also possible in a program control device such as a self-cleaning program according to the invention for example.

The program control device generally has a microcontroller with volatile (RAM) and non-volatile (ROM or EEPROM) memory devices which can be both static and re-writable. The non-volatile memory devices have the same information content after switching on the washing machine as before switching on. The program control device is executed so that the respectively last completely executed washing machine program, for example, the implementation of the appliance testing after manufacture is noted in a re-writable non-volatile memory device ("last program"). After the washing machine has been switched on, which is recognised by the program control device (for example, by a so-called "power on" detection), the program control device checks the memory entry "last program". Only when switching on for the first time does the program control device recognize the entry "appliance testing after manufacture" as "last program" and then brings about a prompt for example on the display of a control panel: "Please carry out self-cleaning of the washing machine. In order to begin the program, press START otherwise INTERRUPT." Further instructions can then be issued following on from this, such as for example the prompt to place detergent in the corresponding device or the specification of a recommended quantity of detergent. If the user of the washing machine acknowledges the prompt with "interrupt", the program control device displays the prescribed program selection of the washing machine on the control panel display and the user can select a program other than self-cleaning.

After carrying out the self-cleaning or another program, the corresponding program name or code is entered by the program control device as "last program" in the memory device. This ensures that after switching on the washing machine again, no renewed instruction for self-cleaning is brought about. This also happens when the name of any proper working program is stored as last stored program, e.g. "colour wash 60° C.".

In order that self-cleaning can also be selected independently of the first putting into operation of the washing machine by the user, self-cleaning is offered as a further program or special program in the prescribed programs of the washing machine. This can be desired for cleaning the machine from dog or cat hairs for example.

Starting the self-cleaning program brings about a program run for cleaning the components coming into contact with water during proper operation. The run consists of the sections "washing" and "rinsing". In the first program section washing, the program control device controls the water supply device and at the same time monitors the water level. Since washing machines generally contain several water supply paths, all supply devices are controlled successively so that all water supply paths are wetted. The entire water supply is controlled until the water level has reached a height at which the laundry drum just comes in contact with the water and the heating device is sufficiently covered with water. During the water intake the laundry drum is moved so that as many components as possible come in contact with water. The water is then heated to a temperature of about 90° C. and the laundry drum continues to be moved. For this the laundry drum is operated with alternating directions of rotation and the ratio of the control to the program section duration is greater than 65%, for example, 70%.

The rotary movement of the laundry drum takes place at a circumferential speed greater than 1.1 m/s. It has proved especially advantageous if the speed of the laundry drum is about 60 1/min; thus, a circumferential speed of about 1.5 m/s is obtained if the drum diameter is about 470 mm. At this drum speed the laundry drum and the soap solution container are efficiently brought into contact with water.

The self-cleaning is further assisted by added cleaning agent. For this purpose a reduced usage of cleaning agents is required compared with the cleaning of textiles. The required quantity of detergent is obtained from the smaller quantity of water required for self-cleaning and the soap solution concentration required for the cleaning process. It has been found that the duration of the "washing" program section can be limited to 20 min to ensure sufficient self-cleaning. At the end of the "washing" program section the program control device triggers the outlet device until the washing machine is completely emptied. In this phase the waste water paths are also cleaned by the warm water or the warm soap solution.

The "washing" program section is followed by the "rinsing" section which again consists of the steps water supply, movement of the laundry drum with alternating direction of rotation and emptying the washing machine. During rinsing the water level is again only so high that the laundry drum just dips into the water. The rinsing primarily serves to remove residue of cleaning agent or the soap solution and/or foam which has formed. Only one rinsing run with a duration of about 5 minutes is required for the self-cleaning and the water is not additionally heated during the rinsing. During the last step, emptying the washing machine, the drive is not controlled. The spinning off of water can be dispensed with since no textiles with associated water are located in the laundry drum. As a result of the method described previously and by means of the water-bearing domestic cleaning appliance, especially a washing machine which has means for carrying out this method, on first putting the washing machine into operation the user is necessarily instructed to carry out a self-cleaning of the washing machine before any prescribed usage. The self-cleaning then takes place according to the method with a short duration using little water, cleaning agent and energy.

The invention is not restricted to the exemplary embodiment. For example, the self-cleaning program according to the invention can also be applied to a dishwasher. Features used in the washing machine can be appropriately applied to the features of the dishwasher. For example, the drive of a washing machine can also appropriately be understood as a circulating pump of the dishwasher. The moving laundry drum of the washing machine can be understood in the case of a dishwasher as at least one moving spray arm where the respective advantageous circumferential speeds of the corresponding components will differ.

The invention claimed is:

1. A method for controlling a program-controlled water-bearing domestic cleaning appliance, comprising the steps of:

providing a program control device for controlling at least one of the following devices present in the water-bearing domestic appliance: a water supply and outlet device, a heating device, and a drive device; the program control device also controlling water temperature, and wherein the program control device operates the water-bearing cleaning appliance according to an article-washing program and according to a self-cleaning program, wherein the self-cleaning program includes steps that are different from the article-cleaning program with the self-cleaning program being selectively operable in an initial switch-on condition and in a user selected switch-on condition, with the initial switch-on condition including an affirmation step activated by a user;

and wherein the program control device determines whether the initial switch-on condition exists, the initial switch-on condition being a post-installation activation of the water-bearing domestic cleaning appliance; and wherein the program control device determines whether a user-activated self-cleaning program has been selected; and, if such an initial switch-on condition or user-activated selection exists, and upon affirmation by the user operating, under the control of the program control device in furtherance of a self-cleaning program, at least one of the water supply, the discharge, the water level, the driving speed, the duration of the drive control within at least one program section, and the duration of at least one program section wherein all components coming into contact with water during article cleaning operation are wetted with at least one of water and cleaning solution.

2. The method according to claim 1, wherein the program control device periodically during the method performs the step of issuing at least one prompt for at least one of an operating action and of information instructions.

3. The method according to claim 2, wherein the program control device during the method performs the step of issuing an instruction as to the required dose of cleaning agent.

4. The method according to claim 1, wherein the program control device operates the water-bearing domestic cleaning appliance at a water level lower than a water level used during normal operations for cleaning of all the components coming into contact with water.

5. The method according to claim 1 wherein the domestic cleaning appliance includes a washing machine and the program control device executes the step of establishing the temperature in a wash program section of about 90° C.

6. The method according to claim 5, wherein the driving speed for a laundry drum in wash and rinse program sections is selected so that the circumferential speed of the laundry drum is greater than 1.1 m/s.

7. The method according to claim 5, wherein in wash and rinse program sections the laundry drum is operated in at least one of alternate directions of rotation and the duration of the drive excitation is greater than 65% of the program duration.

8. The method according to claim 4, wherein the washing machine is emptied in the last program section and in this case the drive is not controlled.

9. A water-bearing domestic cleaning appliance comprising:

a program control device which generates control signals for at least one of a water supply and outlet device, a heater and a drive device such that at least one of the water supply, discharge, water level, the temperature, the driving speed and at least one of the duration of the drive control within at least one program section and the duration of at least one program section are variable;

wherein the program control device is configured for recognizing an initial switch-on condition within the water-bearing domestic cleaning appliance, the initial switch-on condition being an initial post-installation activation of the water-bearing domestic cleaning appliance and a user-activated self-cleaning program setting, and a means for issuing a prompt for carrying out the program for cleaning the components coming into contact with water during article-cleaning operation;

wherein the program control device:

controls at least one of a water supply and outlet device, a heating device, and a drive device;

controls temperature;

controls the following devices and measures such that in a program for cleaning components whose program run consists of a washing program section and a rinsing program section, all components coming into contact with water during proper operation are wetted with at least one of water and cleaning solution in this program section: at least one of the water supply, the discharge, the water level, the driving speed, the duration of the drive control within at least one program section, and the duration of at least one program section; and recognizes an initial switch-on condition within the water-bearing domestic cleaning appliance, the initial switch-on condition being an initial post-installation activation of the water-bearing domestic cleaning appliance, and recognizes a user-activated self-cleaning program setting; and upon recognition of either condition, and thereupon issues a prompt for carrying out a program for cleaning the components.

10. A water-bearing domestic cleaning appliance having at least some internal components thereof that come into contact with water during article-cleaning operation of the water-bearing domestic cleaning appliance, the water-bearing domestic cleaning appliance comprising:

a program control device for controlling operation of the water-bearing domestic cleaning appliance according to a preprogrammed set of operational commands; determining whether an initial switch-on condition exists within the water-bearing domestic cleaning appliance, the initial switch-on condition being an initial post-installation activation of the water-bearing domestic cleaning appliance and, upon determining that the initial switch-on condition exists or upon determining that a user-activated self-cleaning program setting has been selected within the water-bearing domestic cleaning appliance exists; and controlling the program control device to cause the program control device to execute at least one of a washing program section and a rinsing program section, water supply and discharge including controlling at least one of overall water level, at least one of a driving speed and a duration of the drive control within at the least one washing program section and rinsing program section; and the duration of the at least one washing program section and rinsing program section being such that all components coming into contact with water during article-cleaning operation are wetted with at least one of water and cleaning solution.

* * * * *

UNITED STATES PATENT AND TRADEMARK OFFICE

CERTIFICATE OF CORRECTION

PATENT NO. : 7,585,374 B2
APPLICATION NO. : 10/561003
DATED : September 8, 2009
INVENTOR(S) : Christian Eric Sechelmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 886 days.

Signed and Sealed this

Fourteenth Day of September, 2010

David J. Kappos

David J. Kappos
*Director of the United States Patent and Trademark Office*